US006271625B1

(12) United States Patent
Van Engelshoven et al.

(10) Patent No.: US 6,271,625 B1
(45) Date of Patent: Aug. 7, 2001

(54) PICTURE DISPLAY DEVICE PROVIDED WITH AN ELECTRON GUN, AND ELECTRON GUN FOR USE IN SUCH A DEVICE

(75) Inventors: Jeroen Van Engelshoven; Edwin A. Montie, both of Eindhoven; Adrianus H. E. Van Rijsewijk, Sittard; Johannes Th. Peerlings, Eindhoven, all of (NL)

(73) Assignee: U.S. Philips Corporation, New York, NY (US)

( * ) Notice: Subject to any disclaimer, the term of this patent is extended or adjusted under 35 U.S.C. 154(b) by 727 days.

(21) Appl. No.: 08/518,061

(22) Filed: Aug. 22, 1995

(30) Foreign Application Priority Data

Aug. 25, 1994 (EP) ..... 94202433

(51) Int. Cl.[7] ..... H01J 29/51
(52) U.S. Cl. ..... 313/414; 313/412
(58) Field of Search ..... 313/412, 414, 313/409, 449, 460; 315/15, 16, 368, 382.1, 368.15

(56) References Cited

U.S. PATENT DOCUMENTS 3,295,001 12/1966 Burdick et al. ..... 313/82
4,833,364 * 5/1989 Izumida et al. ..... 313/414
4,935,663 * 6/1990 Shimoma et al. ..... 313/412

FOREIGN PATENT DOCUMENTS 0302657 3/1994 (EP) ..... H01J/29/50
61-8832A 1/1986 (JP) ..... H01J/29/50

* cited by examiner

*Primary Examiner*—Michael H. Day

(57) ABSTRACT

A picture display device comprises an evacuated envelope and is provided at a first side with an electroluminescent display screen and at an opposite side with an electron gun (6). Between the electron gun (6) and the display screen, the device comprises deflection means with which an electron beam generated by the electron gun (6) can be deflected during operation. The electron gun (6) has at least an electron beam-generating portion (20) and is provided with a main lens system (40) having a first electrode (41), a final electrode (45) and at least one intermediate electrode (42–44) across which a main lens voltage is gradually applied step-wise during operation so as to form an electron-optical main focusing lens. The intermediate electrode(s) (42–44) comprise a plurality of separate parts (421–423, 431–433, 441–443) whose main faces are positioned against each other and are interconnected.

7 Claims, 2 Drawing Sheets

PICTURE DISPLAY DEVICE PROVIDED WITH AN ELECTRON GUN, AND ELECTRON GUN FOR USE IN SUCH A DEVICE

BACKGROUND OF THE INVENTION

The invention relates to a picture display device comprising an evacuated envelope, a first side of which is provided with an electroluminescent display screen, an opposite side is provided with an electron gun and in which deflection means are arranged between the electron gun and the display screen with which means, at least during operation, an electron beam generated by the electron gun can be deflected, the electron gun having a portion generating at least an electron beam and being provided with a main lens system having a first electrode, a final electrode and at least one intermediate electrode across which a main lens voltage is gradually applied step-wise during operation so as to form an electron-optical main focusing lens. The invention also relates to an electron gun for use in such a device.

Such a device is known from European Patent Specification 302 657. The electron gun described in this Specification comprises two intermediate electrodes between the first electrode and the final electrode of the main lens system and, in comparison with other, more conventional electron guns, it comprises a relatively large number of electrodes For this reason such a main lens is commonly referred to as DML (Distributed Main Lens), MSFL (Multi-Stage Focus Lens) or MEL (Multi-Element Lens). The separate electrodes of the main lens system in the known device are interconnected by means of a resistive voltage divider so that the main lens voltage is gradually distributed step-wise across the electrodes during operation in order to reduce the magnitude of potential jumps in the main lens system. This leads to considerably improved lens properties as compared with more conventional guns in which the main lens voltage is entirely applied across only two electrodes. Notably spherical aberrations can be adequately suppressed to relatively large electron beam currents without an increase of the lens diameter being required.

To enhance the lens action, the intermediate electrodes of the main lens system of the electron gun of the known device are made of a relatively thick sheet material. A thickness of minimally approximately 1–2 mm appears to be desirable in this respect. A drawback of the use of such a thick sheet material is, however, that (mechanical) steps of processing this material are impeded. For example, in such a thick sheet material it is difficult to punch, for example the apparatus for passing the electron beam(s) in the electrodes and consequently considerably longer and more costly techniques such as, for example laser cutting will have to be used. Moreover, the risk of deviations and errors in the apertures and the edges of the electrodes is larger as the sheet material is thicker. These drawbacks are all the more troublesome if the electron gun is to be mass-produced.

SUMMARY OF THE INVENTION

It is, inter alia, an object of the invention to provide a device of the type described in the opening paragraph in which one or more relatively thick intermediate electrodes are used which do not have, or hardly have the above-mentioned drawbacks.

According to the invention, a device of this type described in the opening paragraph is therefore characterized in that the at least one intermediate electrode of the main lens system comprises a plurality of separate plate-shaped parts whose main faces are positioned against each other and are interconnected. The separate plate-shaped parts of the intermediate electrode(s) of the main lens system may thus remain sufficiently thin so that there will be no problems in mass production. For example, the forces exerted, for example when punching the parts for providing, for example apertures for passing electron beams can be maintained sufficiently low so as to limit irregularities and deviations to a minimum. By composing a sufficient number of such parts in conformity with the invention to an intermediate electrode, the thickness of the electrode can be arbitrarily increased so as to obtain a satisfactory lens action.

In this respect parts having a thickness of between 0.3 and 1.5 mm are preferably used in accordance with a special embodiment of the device according to the invention. Such a thickness is sufficiently small to be used without any problems, even in mass production, and is sufficiently large to realise a sufficiently large total thickness of the relevant intermediate electrode, even when a relatively low number of parts is used.

As regards the specific thickness of the intermediate electrodes, a number of factors play a role. For example, the mutual distance between different electrodes is subjected to a given minimum so as to avoid electrostatic breakdown. On the other hand, a too large mutual distance increases the risk of electromagnetic disturbances of the electron beams which are less well shielded in this case. Moreover, an optimum lens filling, i.e. the quotient of the diameter of the beam and the diameter of the lens aperture and the electrode (hereinafter briefly referred to as lens diameter) appears to apply, which is approximately 70% when a colour gun is used. With a smaller lens filling, the definition of the ultimate spot of the electron beam(s) on the display screen deteriorates due to internal repellency of the electrons in the beam, whereas with larger values the beam will experience too much interaction with the metal of the electrodes.

It has surprisingly been found that for a device of the type described a given optimum number of intermediate electrodes can be found, below which number the lens quality clearly deteriorates and above which number there is no essential improvement of the lens quality, while the cost price of the gun increases due to the larger number of electrodes. In connection with the afore-mentioned peripheral conditions, this recognition has led to a special embodiment of the device according to the invention, in which the thickness of the intermediate electrodes is between 30% and 40% of the lens diameter and is more particularly approximately 35% of the lens diameter.

Although manufacturing tolerances in the intermediate electrode(s) of the main lens system in accordance with the invention are limited considerably, such tolerances will inevitably remain. To inhibit their detrimental consequences, a preferred embodiment of the device according to the invention is characterized in that the intermediate electrode comprises an odd number of plate-shaped parts, in which an even number of at least substantially uniform first parts is arranged in a mirrored relationship around a central, second part. In that case the electron-optical influence of possible manufacturing errors in a first part is at least partly compensated by an opposite influence of the mirror image thereof in the form of the uniform first part which is placed at the other side of the second part.

A special implementation of the preferred embodiment of the device according to the invention is characterized in that the central, second part is provided with securing means for securing said second part to an insulating support.

BRIEF DESCRIPTION OF THE INVENTION

These and other aspects of the invention will be apparent from and elucidated with reference to the embodiments described hereinafter.

In the drawing.

The figures are purely diagrammatic and not to scale. For the sake of clarity, some dimensions are exaggerated. Corresponding components in the Figures have been given identical reference numerals as much as possible.

DESCRIPTION OF THE PREFERRED EMBODIMENTS

Figure 1:
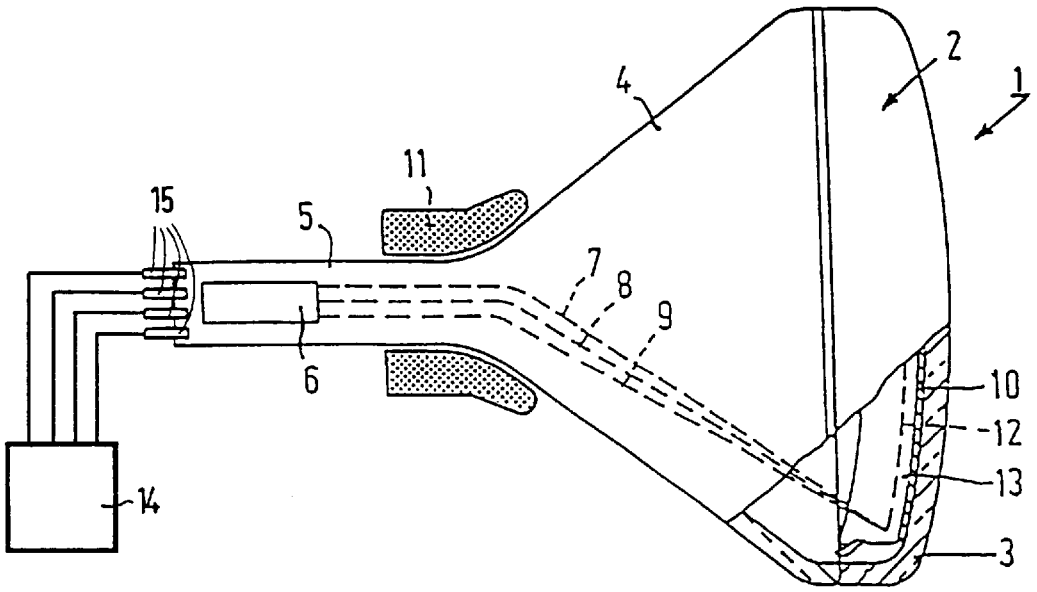
FIG. 1 is a diagrammatic cross-section of an embodiment of the picture display device according to the invention.

The embodiments of the picture display device according to the invention shown in FIG. 1 is provided with a cathode ray tube 1 having an evacuated envelope 2 with a display window 3, a cone 4 and a neck 5. The neck 5 accommodates an electron gun 6 for generating, in this embodiment, three electron beams 7–9. It is to be noted that within the scope of the invention the term electron gun should be considered to have a wide meaning and that it does not only include a single gun suitable for generating only one electron beam but also integrated or non-integrated systems of often three electron guns which are described, for example in the present embodiment.

An electroluminescent display screen 10 which, in this embodiment comprises red, green and blue phosphor elements is present at the inner side of the display window 3. The outer side of the envelope 2 is provided with deflection means 11 which are only shown diagrammatically and generally comprise a deflection unit in the form of a system of magnetic coils. On their path to the display screen 10, the electron beams 7–9 can be deflected by means of the deflection unit so that the entire display screen 10 can be scanned, and the beams pass a colour selection means 12 which in this embodiment comprises a shadow mask in the form of a plate having apertures 13. The beams 7–9 pass the apertures 13 at a small mutual angle and thus only impinge on phosphor elements of the colour associated with the relevant beam 7, 8, 9. The picture display device further comprises means 14, shown diagrammatically, for applying electric voltages to the electrodes of the electron gun, which means are connected to the electron gun 6 in the final product by means of lead-through electrodes 15. The assembly further has a housing (not shown).

Figure 2:
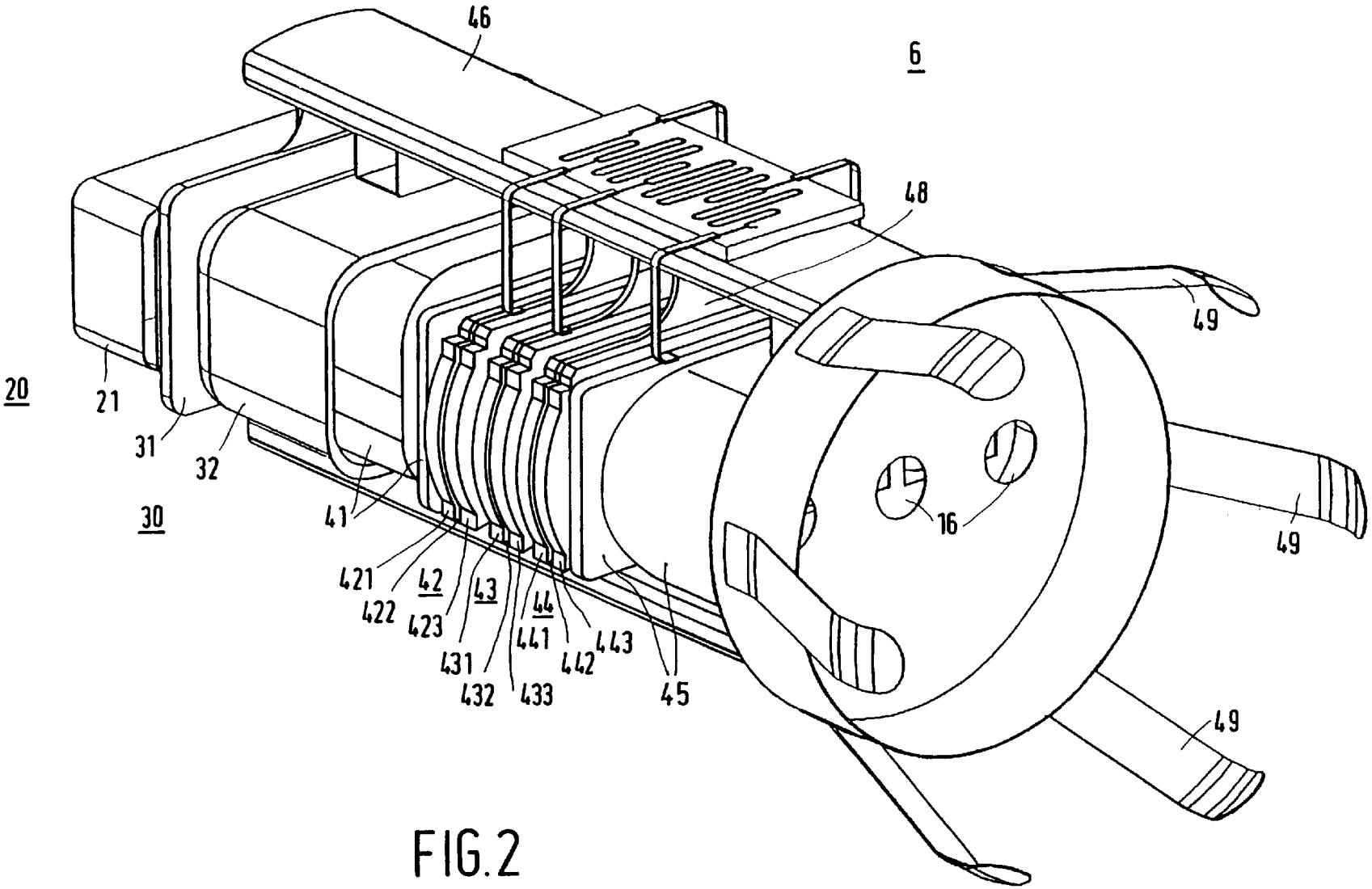
FIG. 2 is a perspective and larger view of the structure of the electron gun of the picture display device of FIG. 1.

The electron gun 6 of the device of FIG. 1 is shown in perspective and greater detail in FIG. 2. The gun 6 comprises an electron beam-generating portion 20 referred to as the triode, in which three juxtaposed electron sources are incorporated which are provided with a common electrode 21, often referred to as G1 which is connected to ground during operation. Similarly as all other electrodes of the electron gun 6, the common electrode 21 is provided with three apertures 16 aligned in a row and having a diameter of approximately 5.5 mm for passing the electron beams. This diameter will hereinafter be referred to as the lens diameter.

The gun 6 also comprises a prefocusing section 30 which is constituted by two successive electrodes 31, 32 having operating potentials of typically 400–500 volts and 5–6 kV, respectively which are usually denoted as G2 and G3, respectively. The electron-optical prefocusing lens which is constituted by this system 31, 32 of electrodes provides a virtual image of the electron sources which serves as an object for a main focusing lens constituted in a subsequent main focusing section of the gun.

The main focusing section comprises a main lens system 40 having a first electrode (41), a final electrode (45) and three intermediate electrodes (42–44) across which a main lens voltage of typically 25–30 kV is applied during operation. In this embodiment, a potential $V_g$ of 5–6 kV is present during operation at a first electrode 41 of the system, while the potential of the last electrode 45 which is generally referred to as anode is 30–35 kV during operation.

In the main lens system of the device described, the main lens voltage is distributed gradually and step-wise across the five electrodes (41–45) of the main lens system (40). To this end the intermediate electrodes 42–44 are interconnected by means of a resistive voltage divider 46 and connected to the outer electrodes 41, 45 of the system. By this uniform and step-wise spread of the main lens voltage across the five electrodes, the potential jump between adjacent electrodes in the main lens system may remain limited to 5–15 kV, which has an extremely favourable effect on the lens action of the main lens. Thus, for example spherical aberrations can be adequately inhibited, even at larger beam currents without an increase of the lens diameter being required.

There appears to be a relation between the quality of the lens and the thickness of the intermediate electrodes 42–44 in the sense that, as this thickness is larger to a certain extent, the lens action improves. In this respect a number of factors play a role. For example, the mutual distance between different electrodes is subject to a given minimum so as to avoid electrostatic breakdown. On the other hand, a too large mutual distance increases the risk of electromagnetic disturbances of the electron beams which in this case are less well shielded. Moreover, an optimum lens filling, i.e. the quotient of the diameter of the beam and the diameter of the lens aperture 16 in the electrodes 42–44 appears to apply, which lens filling is approximately 70% when the colour gun described is used. At a smaller lens filling the definition of the ultimate spot of the electron beams 7–9 on the display screen 10 deteriorates due to internal repellency of the electrons in the beam, whereas at larger values the beam is subject to a too large interaction with the metal of the electrodes 42–44.

Moreover, a given optimum number of electrodes may be found, below which number the lens quality clearly deteriorates and above which there is no essential improvement of the lens quality, while the cost price of the gun increases due to the larger number of electrodes. This leads to an optimum electrode thickness of 30–40% of the aforementioned lens diameter. Accordingly, in the embodiment described a thickness of 35% of the lens diameter is used for the electrodes 42–44, which diameter will then be 2.0 mm in this embodiment.

Figure 3:
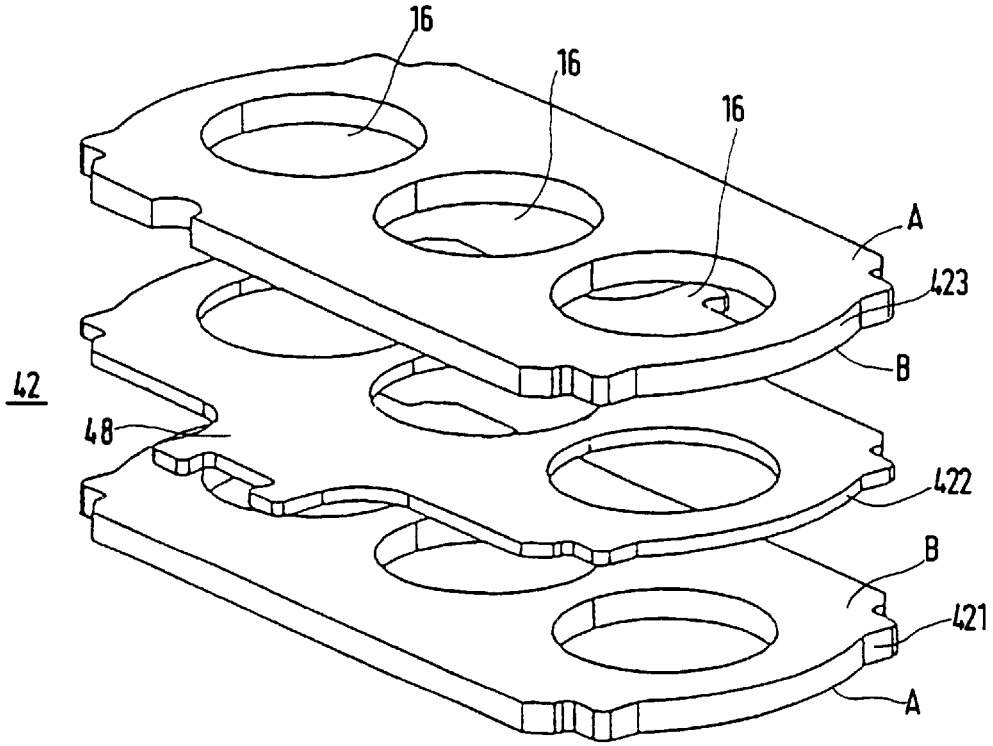
FIG. 3 shows, broken away, one of the intermediate electrodes of the main lens system of the electron gun of FIG. 2.

According to the invention, this is achieved in that the intermediate electrodes comprise a plurality of, three in this embodiment, separate plate-shaped parts 421–423, 431–433, 441–443 whose main faces are positioned against each other and are interconnected. FIG. 3 shows in a broken-away view one of the intermediate electrodes of the gun of FIG. 2 in which this is shown more clearly.

By thus starting from separate parts, the thickness of the sheet material used for this purpose may remain sufficiently thin so as to be processed without any problems also in mass production. Consequently, manufacturing errors and deviations of the components remain limited, which contributes to the ultimate quality of the lens. In this embodiment, the outer parts of the intermediate electrodes are made of approximately 0.8 mm thick sheet material and the central part is made of approximately 0.4 mm thick sheet material of stainless steel. After having been fixed with respect to each other, the separate parts are welded together at a number of points.

To limit the influence of possibly remaining manufacturing errors, each intermediate electrode 42–44 in this embodiment comprises an odd number of three parts, in which the two uniform outer parts are arranged in a mirrored relationship around the central part. Consequently, the main faces of the outer parts which are subjected to the same processing steps during manufacture are mirrored with respect to the centre of the relevant electrode. In that case deviations in the lens action caused by the outer part are compensated by at least substantially equal but opposite deviations in the other outer part. The influence of inevitable manufacturing tolerances can thus be limited to a minimum in the device according to the invention.

The different components of the gun are held together at both sides by means of an insulating support 46, which is often referred to as multiform rod or beading rod and are fixed with respect to each other. The required securing means 48 are always provided on the central one of the three parts in the intermediate electrodes 42–44 in the form of beading brackets with which the electrodes are pressed into the insulating support 46 at an elevated temperature, which support is in a slightly fluid condition. The assembly further comprises a plurality of radially arranged centring springs 49 with which the gun is centred in the neck 5 of the envelope 2 and with which the high voltage for the anode 45 can be taken from the tube wall. At the opposite side, the gun is provided with lead-through electrodes 15 which for the sake of clarity of the Figure have been omitted, but with which the other potentials required in the gun can be applied.

Although the invention has been described with reference to a single embodiment, it will be evident that it is by no means limited thereto and that those skilled in the art will be able to conceive many variations and designs within the scope of the invention. For example, the invention is not only suitable for a gun of the above-described bipotential type but also for unipotential and three-potential guns in which a potential is associated with at least one of the electrodes of the main lens system. Moreover, within the scope of the invention, a larger or smaller number than three electrodes can be used between the first and last electrodes of the main lens system and all the different intermediate electrodes may be made or not made of more than three parts so as to increase the total thickness of the electrodes or further limit the thickness of the separate parts. Moreover, the invention is not only suitable for a colour display device having an integrated colour gun but also for a colour display device having (three) separate electron guns, and for monochrome picture display devices.

Generally, the invention provides a picture display device of the type described in the opening paragraph with an electron gun which is provided with a multiple main lens having relatively thick intermediate electrodes which thus give rise to a good lens quality without impeding the manufacturing process.

What is claimed is:

1. A picture display device comprising an envelope containing an luminescent display screen and an electron gun for producing at least one electron beam for deflection across the display screen, said electron gun comprising a main lens system having a first electrode, a second electrode, and at least one intermediate electrode disposed between said first and second electrodes, each of said electrodes having at least one aperture for passing the at least one electron beam, said at least one intermediate electrode comprising substantially identical, conductive first and second plates and means for conductively attaching said plates to each other with the at least one aperture in the first plate aligned with the at least one aperture in the second plate, where the at least one aperture in each of the first and second plates has a predetermined diameter and where the thickness of the at least one intermediate electrode is between 30% and 40% of said predetermined diameter.

2. A picture display device comprising an envelope containing an luminescent display screen and an electron gun for producing at least one electron beam for deflection across the display screen, said electron gun comprising a main lens system having a first electrode, a second electrode spaced apart from the first electrode, and at least one intermediate electrode disposed between said first and second electrodes, said at least one intermediate electrode comprising an odd number of apertured plates including:

a. a conductive central plate including at least one aperture for passing the at least one electron beam, said central plate having:
   i. a first side facing the first electrode; and
   ii. an opposite second side facing the second electrode;

b. conductive first and second plates attached to the first and second sides of the central plate, respectively, each including at least one aperture corresponding to the at least one aperture of the central plate, said first and second plates being substantially identical to each other;

where the at least one aperture in each of the first and second plates has a predetermined diameter and where the thickness of the at least one intermediate electrode is between 30% and 40% of said predetermined diameter.

3. A picture display device as in claim 1 or 2 where said thickness is approximately 35% of the predetermined diameter.

4. A picture display device as in claim 1 or 2 where each of the first and second plates has a thickness between 0.3 and 1.5 mm.

5. A picture display device as in claim 1 or 2 where the first and second plates are oriented in a mirror-image orientation with respect to each other.

6. A picture display device comprising an envelope containing an luminescent display screen and an electron gun for producing at least one electron beam for deflection across the display screen, said electron gun comprising a main lens system having a first electrode, a second electrode, and at least one intermediate electrode disposed between said first and second electrodes, each of said electrodes having at least one aperture for passing the at least one electron beam, said at least one intermediate electrode comprising substantially identical, conductive first and second plates and means for conductively attaching said plates to each other with the at least one aperture in the first plate aligned with the at least one aperture in the second plate, where the first and second plates are oriented in a mirror-image orientation with respect to each other.

7. A picture display device comprising an envelope containing an luminescent display screen and an electron gun for producing at least one electron beam for deflection across the display screen, said electron gun comprising a main lens system having a first electrode, a second electrode spaced apart from the first electrode, and at least one intermediate electrode disposed between said first and second electrodes, said at least one intermediate electrode comprising an odd number of apertured plates including:

a. a conductive central plate including at least one aperture for passing the at least one electron beam, said central plate having:

i. a first side facing the first electrode; and ii. an opposite second side facing the second electrode;

b. conductive first and second plates attached to the first and second sides of the central plate, respectively, each including at least one aperture corresponding to the at least one aperture of the central plate, said first and second plates being substantially identical to each other;

where the first and second plates are oriented in a mirror-image orientation with respect to each other.

* * * * *